United States Patent [19]

Sorlien

[11] Patent Number: 4,611,716

[45] Date of Patent: Sep. 16, 1986

[54] CLOSABLE HANGING VESSEL AND METHOD OF USE

[76] Inventor: Mark D. Sorlien, 1915 Birch Ave., White Bear Lake, Minn. 55110

[21] Appl. No.: 728,239

[22] Filed: Apr. 29, 1985

[51] Int. Cl.[4] ..... B65D 1/24; A45D 42/14

[52] U.S. Cl. ..... 206/581; 206/806; 206/829; 206/77.1; 132/79 F; 132/79 G; 248/206.3

[58] Field of Search ..... 206/581, 229, 228, 806, 206/823, 829, 77.1; 132/79 R, 79 F, 79 G; 248/206.3, 206.4

[56] References Cited

U.S. PATENT DOCUMENTS

| | | | |
|---|---|---|---|
| 257,973 | 5/1882 | Pattberg | 206/581 |
| 1,255,537 | 2/1918 | Keor | 132/79 F |
| 1,699,149 | 1/1929 | Mahler | 132/79 R |
| 2,187,445 | 1/1940 | de Botelho | 206/581 |
| 2,457,918 | 1/1949 | Pierce . | |
| 2,466,502 | 4/1949 | Stiller | 248/206.4 |
| 2,842,893 | 7/1958 | Howerton . | |
| 3,656,727 | 4/1972 | Greenlee | 206/806 |
| 3,677,951 | 7/1972 | Alles | 15/104.9 X |
| 3,688,895 | 9/1972 | Wilson | 206/77.1 |
| 3,899,073 | 8/1975 | Barr | 206/77.1 |
| 4,344,529 | 8/1982 | Ibarzabal | 206/77.1 |
| 4,453,279 | 6/1984 | Logsdon . | |

FOREIGN PATENT DOCUMENTS

| | | | |
|---|---|---|---|
| 656613 | 1/1963 | Canada | 206/77.1 |
| 754486 | 11/1933 | France | 132/79 G |

*Primary Examiner*—William Price
*Assistant Examiner*—Brenda J. Ehrhardt
*Attorney, Agent, or Firm*—Merchant, Gould, Smith, Edell, Welter & Schmidt

[57] ABSTRACT

A closable vessel including a main body portion and a hingeably affixed lid portion. A suction cup affixing structure is providing on either the lid or the back of the main body for removably affixing the vessel to a surface. When affixed the vessel presents its contents at an appropriate angle between the horizontal and the vertical for easy access by the user and to allow drainage of water. Drain holes accomplish drainage and provide ventilation to the contents when the vessel is closed. Alternate embodiments include use of partitions and a retaining bar for holding the contents. Further, a mirror may be provided for shaving or the like.

10 Claims, 6 Drawing Figures

CLOSABLE HANGING VESSEL AND METHOD OF USE

TECHNICAL FIELD

The present invention relates generally to the field of closable containers, and in particular to a container having a means for affixing the lid portion to a vertical surface so that the main body portion hangs at a convenient angle to present the contents for use.

BACKGROUND

Carrying personal hygiene items such as soap, shampoo, hair conditioners, shaving razors and the like for use while away from home is difficult. With the popularity of health clubs, and the number of persons traveling for business and pleasure, the need for a convenient, simple and practical way to carry soap, shampoo and similar items while away from home is apparent.

Previously, hotels and health clubs have many times provided soap, shampoo and the like to their patrons. This often results in wasting soap as each patron obtains a new bar, and many times a patron is unable to use his or her favorite brand of soap or shampoo. The only previous alternative to this problem is for each patron to bring his own bath accessories. This necessitates bringing a number of bottles, soap containers and the like which is inconvenient and cumbersome.

Prior art devices in this area include the device shown and described in U.S. Pat. No. 4,453,279 which has a portable rack for holding toiletries. U.S. Pat. No. 3,677,951 discloses a bar of soap or the like including a suction cup structure for affixing the soap to a surface. U.S. Pat. No. 2,457,918 discloses a mesh type basket for holding a bar of soap or the like, the basket being affixed to a wall with a suction cup. U.S. Pat. No. 2,842,893 discloses a soap tray affixed to a wall with suction cups and including a pivoting wire soap rack.

The present invention has significant advantages over those shown in the prior art in that the present invention is extremely portable, and is closable to isolate the contents so the container can be placed directly into a suitcase or gym bag. The present invention is removably affixable to a surface so that the container hangs at a convenient angle for presentation of the contents of the user while allowing moisture which enters the vessel to drain directly through drainage holes. Containers for liquid toiletries and a bar of soap are retained within the vessel because of the angle at which the vessel hangs.

These and other advantages of the invention over the prior art will become more apparent after reading the description and claims which follow.

SUMMARY OF THE INVENTION

The invention is a closable vessel having a main body portion with a planar floor and a hingeably affixed lid. The vessel includes a means for affixing the lid to a vertical surface so that the floor of the main body hangs betweeen the horizontal and vertical directions. The vessel receives a number of containers for holding soap, shampoo, hair conditioner and the like; a razor and mirror may also be provided. With this device, the user can take his or her personal soap, shampoo and the like directly into a shower or bath. The toiletries are thus readily available for use, and a convenient mirror and razor are at hand. After use, the suction cups can be removed from the surface, the vessel closed, and the container placed directly in a suitcase, gym bag or the like. Ventilation of the contents is provided through the drain holes while the vessel retains the contents and prevents wet soap or the like from contacting clothing or the like.

An optional embodiment, further includes partition members within the main body to further restrain containers and the like within the vessel. Further, a web with suction cups facing in opposite direction can be employed to removably affix the vessel to a surface while the oppositely facing suction cups pass through holes in the lid to retain a mirror on the inside of the lid. A second alternate embodiment places the suction cups on the main body portion of the device and retains the containers and soap within the vessel with a retaining bar which spans the opening of the main body.

A fastener to retain the lid in a closed position and a living hinge between the lid and main body portion are provided in each embodiment. The mirror and razor are optional. The location and number of drain holes vary between the embodiments.

DETAILED DESCRIPTION OF THE INVENTION

Throughout the following description reference will be made to the drawings and the same numerals will be used throughout the several views to indicate the same or like parts of the invention.

Figure 1:
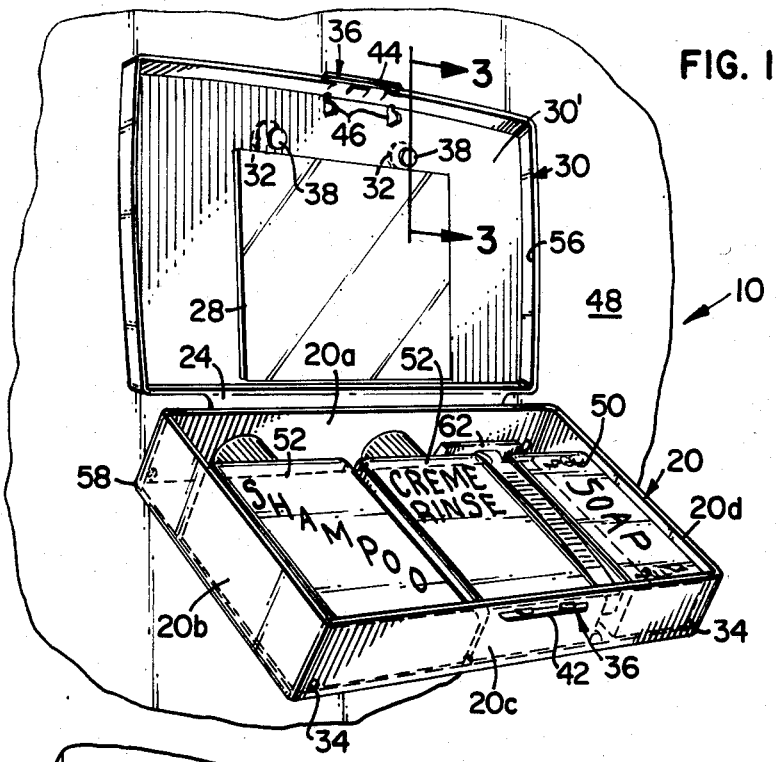
FIG. 1 is a perspective view of the preferred embodiment of the present invention in the open position.
Figure 3:
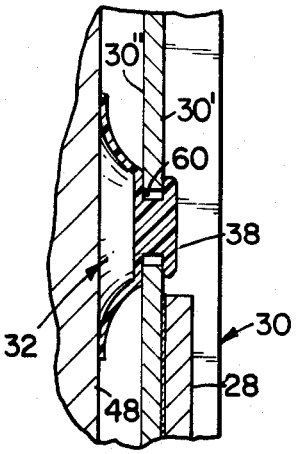
FIG. 3 is a partial side elevational view of the embodiment in FIG. 1, on an enlarged scale.
Figure 6:
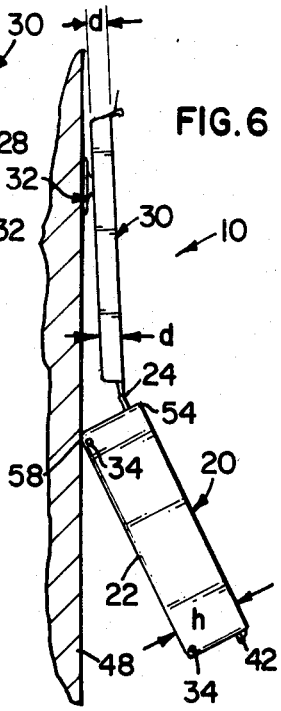
FIG. 6 is a side elevational view of the embodiment shown in FIG. 1 on a reduced scale.

Referring specifically to FIGS. 1, 3 and 6 the invention comprise a closable vessel 10. The vessel includes a main body 20 having a planar bottom 22 and four sides, (20*a, b, c* and *d* respectively) each perpendicular and contiguous with the bottom. The sides rise above the plane of the bottom 22 to form a box.

A lid portion 30 has an inside 30' and an outside 30" and is hingeably connected to one of the sides of the box (20*a*). The lid portion is movable from a first position wherein the vessel is open (see FIG. 1) to a second position wherein the lid cooperatively engages the four-sides of the box and lies in a plane parallel to and spaced from the bottom. In this second position the vessel is closed. (The closed position is generally illustrated by the arc shaped broken line in FIG. 2.)

A means for removably affixing the vessel to a smooth surface is provided. The preferred means includes at least one suction cup 32 affixed to the lid 30. In the preferred embodiment, the suction cup is affixed to the outside 30" of the lid 30. (See FIG. 3.) Drain holes 34 are provided in the sides and the bottom of the main body. The lid further includes a two piece latching mechanism 36 for latching the lid to the body when in the second position. This latching mechanism may include a hook 44 affixed to the lid 30 for cooperatively engaging a flange 42 when the vessel is closed, and a guide 46 on the inside surface 30' of the lid 30. The guide 46 retains the side 20c of the box in position for latching engagement of the hook 44 on the flange 42.

It should be noted that when the lid is in the first position and the vessel is affixed to a smooth vertical surface 48, the bottom 22 of the main body portion 20 hangs between the horizontal and vertical directions. This presents the contents which includes a bar of soap 50 and a number of suitably sized containers 52 for holding shampoo, cream rinse and the like, at a convenient angle. Further, when the device is installed in a shower, and moisture or water enters the vessel, the drainage holes 34 allow water passing over the bottom 22 under the force of gravity to exit the vessel. For drainage of water during use, it is only necessary to have drainage holes down hill or down the slope of the hanging floor or bottom 22. Providing holes in the upper corners of the main body portion 20, and also in the lid 30 provides superior ventilation of the contents when the lid is closed. These upper holes also provide drainage when the vessel is closed yet still attached to the wall.

In reference specifically to FIG. 1, the preferred embodiment includes two suction cups 32 affixed to the lid 30. For ease of assembly, these suction cups may include buttons 38 which are passed through openings provided in the lid. (See FIG. 3.) The buttons 38 can be formed integrally with the suction cups 32. A mirror 28 may be glued, welded or otherwise affixed to the inside 30' of the lid 30 below the buttons 38 of the suction cups 32. A living hinge 24 connects the lid to the main body. A living hinge is simple to manufacture, is flexible yet somewhat firm, and, when the container is made of polypropylene or polyethylene, will retain some "memory". As seen in FIG. 6 the living hinge 24 has a narrowed portion along which the hinge bends.

As seen best in FIG. 6, the preferred embodiment will hang so that the floor or bottom 22 lies between 10° and 50° of arc above the vertical. In fact, as seen in FIG. 6, the floor lies approximately 30° of arc above the vertical. This angle proves ideal for retaining the contents for easy access by the user, and allowing efficient drainage while in use, yet retains the containers 52 within the vessel.

The construction of the device for achieving this optimal angle is important. The angle at which the bottom 22 hangs is a function of, among other things, the weight within the box, the positioning of the suction cups on the lid, the positioning of the hinge connection above the floor of the box, and the "memory" of the hinge. The relationship between the height (h) of the wall of the box and the depth (d) of the lip of the lid are also factors. By affixing the hinge to the wall of the box more than one-half of the height of the wall from the floor, a suitable angle is achieved. Ideally, the hinge 24 is affixed to the wall 20a of the box as far from the bottom 22 as possible. In the embodiment shown in FIG. 6, this maximum distance is determined by the need to place the hinge 24 from the edge 54 of side 2a a distance equal to the depth (d) of the lip 56 of the lid 30.

Where the side 20a joins the bottom 22 of the box, a butt 58 is formed. In use, the butt 58 will normally rest against the wall 48. (See FIG. 6.) The force exerted by the butt 58 portion of the box increases with the distance of the hinge 24 from the butt 58. Increasing this force increases the angle of the bottom 22 above the vertical. This is due to the corresponding or opposite force on the butt portion 58 exerted by the wall 48. The above-described forces are the result of careful box design and engineering.

Moving the suction cups 32 closer to the hinge 24 will increase the force of the wall on the butt 58. If heavy items are intended to be carried in the box, it is beneficial to provide additional suction cups on the lid in a location nearer to the hinge than shown in FIG. 1. In this way, it is possible to more securely affix the device to the surface and allow the box to support heavy items such as hand tools or the like. For use as a shower aid, the design of FIG. 6 is appropriate.

Figure 2:
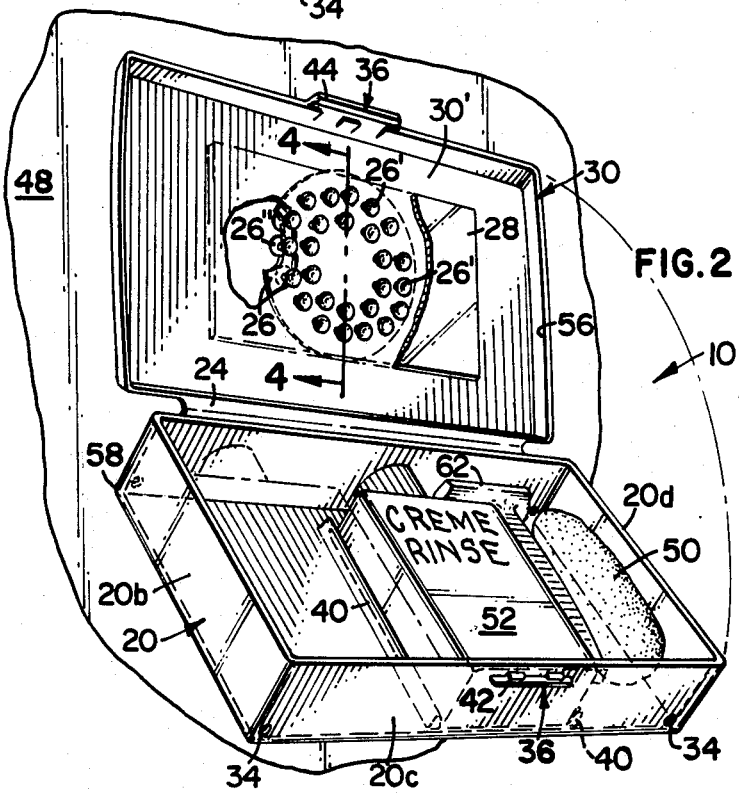
FIG. 2 is a perspective view of an alternative embodiment.
Figure 4:
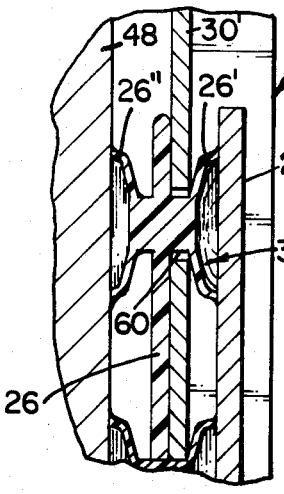
FIG. 4 is a partial side elevational view of the embodiment shown in FIG. 2 on an enlarged scale.

Turning now to FIGS. 2 and 4, an alternative embodiment is disclosed. This version of the invention includes a suction cup web 26 having suction cups facing in opposite directions. (26' and 26'' respectively.) The suction cups facing in one direction (26'') are used to affix the device to a smooth vertical surface 48. The oppositely facing suction cups (26') pass through access openings 60 in the lid and are affixed to the back surface of a mirror 28. In this way the suction cup web 26 retains the mirror and affixes the vessel to the surface.

Also shown in FIG. 2 are partition members 40 which are contiguous with the bottom 22 and lie substantially parallel to one of the sides of the box while extending above the plane of the bottom 22. The partitions 40 are parallel to side 20b in this instance. These partitions further constrain the contents such as the containers 52, the soap 50 and the razor 62.

Figure 5:
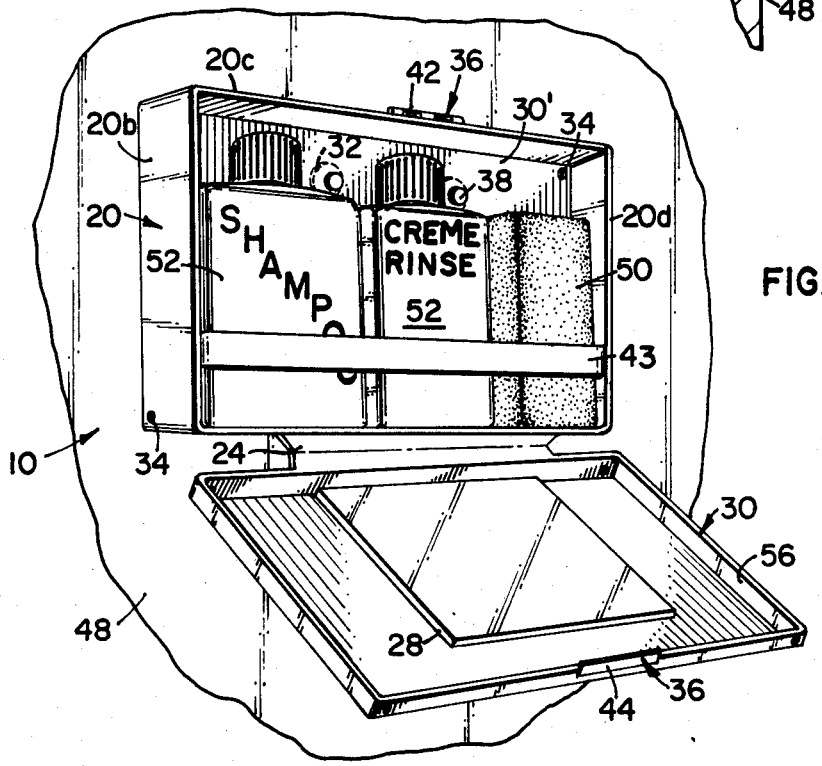
FIG. 5 is a perspective view of a second alternative embodiment.

In reference now to FIG. 5, a second alternative embodiment is disclosed. In this version of the invention, the suction cups 32 are affixed to the outside, of the bottom 22 of the main body portion of the box. The containers 52 and soap 50 are retained within the main body portion by a retaining bar 43 affixed to opposite sides (20b and 20d) of the box and spanning the opening thereof. In this embodiment, the lid 30 will hang at an angle determined primarily by the weight of the lid and the "memory" of the hinge 24. If the hinge offers no resistance to the force of gravity, the lid will hang perpendicularly. With the proportions of the device as shown in FIG. 5, there is no portion of the lid which "butts" against the wall.

As perhaps best seen in FIG. 5, the lid includes a lip 56 extending around the perimeter of the lid 30. When the box is in a closed position, the lip will extend toward the bottom 22 of the box and fit over and partially cover the sides 20a–d. The lip 56 feature may be included in each of the above-described embodiments.

METHOD OF USE

As can be readily understood from the above-description and the drawings, an adventageous method of using the present invention exists. As described above, the device 10 includes a main body portion 20 with a planar bottom 22 and four sides (20a, 20b, 20c, and 20d) which form a box. A lid 30 for the box is provided with a means for removably affixing the vessel to a smooth surface provided on the outside 30'' of the lid. A mirror 28 may be provided on the inside 30' of the lid, and the affixing means may include a suction cup 32. A number of containers 52, sized to fit within the main body portion are also provided. The side 20a of the box which includes the hinge mechanism 24 forms a butt portion 58 where it joins the bottom of the box.

The device is used by opening the lid and pressing the suction cups to the vertical surface 48 to affix the vessel to a wall at a height for convenient use. This height may be determined by the user's desire to have the mirror at eye level. The user then rests the butt portion of the box against the wall to partially support the floor, and positions the main body portion to hang at an appropriate angle above the vertical direction. These steps may be preceded by wetting the wall or the suction cups to increase adhesion. The contents including the containers 52 are retained within the vessel by the force of gravity. The angle at which the container hangs allows easy access to the contents by the user, but allows water which enters the main body to pass over the bottom 22 and exit through drain holes 34. After use of the contents, the vessel may be removed from the wall and closed for storage or transport to another location.

Alternatively, the vessel may be placed on the wall in the closed position and then opened by pressing on side 20*c* just beneath the flange 42. The bottom 22 will then hang at an appropriate angle. Following use of the contents the vessel can be closed before removing the vessel from the wall 48. In this way the contents will continue to drain through the upper drain holes (which are now at the lower most portion of the box) and additional shower water will not enter the vessel as it is substantially closed. The vessel can then be removed for transport or storage, or can be left affixed to the wall for furture use.

The alternative embodiments of the invention are used in analagous ways as can be understood from the above-description and reference to the drawings. In light of the above teachings it will be appreciated that several variations of the disclosed embodiments are possible. Those skilled in the art will no doubt be able to utilize the principles of this invention other than as specifically described above. Certainly substitution of other materials and variations of the relationships of size and positioning of components within the teachings of this disclosure will be readily known. Therefore, it is to be understood that the scope of the invention is to be limited only by the following claims.

I claim:

1. A closable vessel including:

a main body having a planar bottom and four sides each perpendicular to and contiguous with said bottom and rising above the plane of said bottom to form a box;

a lid portion having an inside and an outside, said lid hingeably connected to one of said sides and movable from a first position wherein the vessel is open to a second position wherein said lid cooperatively engages said four sides and said lid lies in a plane substantially parallel to and spaced from said bottom and said vessel is closed; the improvement comprising:

(a) a means for removably affixing said vessel to a smooth surface, said means including a single suction cup web including suction cups facing in opposite directions and a number of said cups extending through openings in said lid for affixing a mirror to said lid while said oppositely facing cups affix said vessel to said smooth surface, said suction cup means located on the outside of said lid so that when said lid is in said first position and said vessel is affixed to said smooth vertical surface, said plane of said bottom portion hangs between 10 and 50 degrees above the vertical direction;

(b) drain holes provided in said sides and said bottom of said main body;

(c) means for latching said lid to said body when said lid is in said second position;

(d) a container for liquid soap or shampoo, said container sized to fit within said main body portion and retained within said vessel, said container retained against the bottom and one of said sides by gravity;

(e) partition members contiguous with said bottom and lying substantially parallel to one of said sides and extending above said bottom plane; and (f) a living hinge connecting said lid and said main body.

2. The vessel of claim 1, further comprising:

drain holes provided through said lid.

3. The vessel of claim 1, further comprising a lip extending around the perimeter of said lid and extending toward said bottom when said lid is in said second position; said lip sized to partially cover said sides.

4. The vessel of claim 3, further comprising drain holes provided in said lip.

5. A closable vessel including:

a main body having an inside and an outside, a planar bottom and four sides each perpendicular to and contiguous with said bottom and rising above the plane of said bottom to form a box;

a lid portion having an inside and an outside, said lid hingeably connected to one of said sides and movable from a first position wherein the vessel is open to a second position wherein said lid cooperatively engages said four sides and said lid lies in a plane substantially parallel to and spaced from said bottom and said vessel is closed; the improvement comprising:

(a) a means for removably affixing said vessel to a smooth surface, said means including suction cup means affixed to the said outside of said bottom;

(b) a mirror affixed to the said inside of said lid;

(c) drain holes provided in said sides and said bottom of said main body;

(d) means for latching said lid when in said second position;

(e) a retaining bar affixed to two of said sides opposite said bottom and spanning the opening in said box; and (f) a living hinge connecting said lid and said main body.

6. The vessel of claim 5 further comprising a container for liquid soap or shampoo, said container sized to fit within said main body portion and retained within said vessel between said bar, and said bottom.

7. The vessel of claim 5, further comprising:

partition members contiguous with said bottom and lying substantially parallel to one of said sides and extending above said bottom plane.

8. The vessel of claim 5, further comprising:

drain holes provided in said lid.

9. The vessel of claim 5 wherein said suction cup means are located on the outside of said bottom so that when said lid is in said first position and said vessel is affixed to a smooth vertical surface said lid portion hangs between the horizontal and vertical directions.

10. A method of using a bath accessory storage device having:

a main body with a planar bottom and four sides each perpendicular to and contiguous with said bottom and rising above the plane of said bottom to form a box;

a lid portion having an inside and an outside, said lid hingeable connected to one of said sides and movable from a first position wherein the vessel is open to a second position wherein said lid cooperatively engages said four sides and said lid lies in a plane substantially parallel to and spaced from said bottom and said vessel is closed; a means for removably affixing said vessel to a smooth vertical surface, said means including suction cup means affixed to the said outside of said lid; a mirror affixed to the said inside of said lid; drain holes provided in said sides and said bottom of said main body; means for latching said lid when in said second position; and a container for liquid soap, shampoo or conditioner; said container sized to fit within said main body portion of said vessel; said side which includes said hingeably connected lid forming a butt portion where said side joins said bottom; and a living hinge connecting said lid and said main body;

said method comprising the steps of:

a. pressing the suction cups to the vertical surface to affix the vessel to said wall at a height for convenient use;

b. resting said butt portion against said wall to partially support said bottom;

c. positioning said main body portion to hang between 10° and 50° above the vertical direction to retain said container within said vessel, but to allow easy access to said container by the user, and so that water which enters said main body passes over said bottom and exits said body through said drain holes.

* * * * *